United States Patent [19]

Desormiere

[11] 3,968,457

[45] July 6, 1976

[54] MICROWAVE NON-RECIPROCAL JUNCTION DEVICE

[75] Inventor: Bernard Desormiere, Paris, France

[73] Assignee: Thomson-CSF, Paris, France

[22] Filed: Feb. 11, 1975

[21] Appl. No.: 549,051

[30] Foreign Application Priority Data

Feb. 12, 1974 France ..... 74.04657

[52] U.S. Cl. ..... 333/1.1; 333/24.1

[51] Int. Cl.[2] ..... H01P 1/34; H01P 1/38

[58] Field of Search ..... 333/1.1, 24.1, 73 S, 333/84 R, 84 M

[56] References Cited

UNITED STATES PATENTS

| | | | |
|---|---|---|---|
| 3,602,845 | 8/1971 | Agrios et al. | 333/24.1 |
| 3,755,759 | 8/1973 | Cohn | 333/84 R X |
| 3,769,617 | 10/1973 | West | 333/84 R |

*Primary Examiner*—Paul L. Gensler

*Attorney, Agent, or Firm*—Cushman, Darby and Cushman

[57] ABSTRACT

A multiple channel non-reciprocal junction device for the transmission of microwaves. It is constituted by a wafer of ferrimagnetic material, to which there is applied in a longitudinal direction a uniform magnetic field; the wafer is covered, alternately on each of its faces, with transverse metal layers which are not opposite one another; each of the channels corresponds to a section of wafer metallized on both its faces and provided at its ends with means for the emission and reception of the microwave which is to be transmitted.

6 Claims, 3 Drawing Figures

MICROWAVE NON-RECIPROCAL JUNCTION DEVICE

The present invention relates to a multiple channel non-reciprocal junction device for the transmission of microwaves, said device being made of ferrimagnetic material.

Those skilled in the art will appreciate that ferrimagnetic materials have the property, when subjected to a substantially uniform direct magnetic field, of transforming a microwave electromagnetic excitation applied to them, in particular into a spin wave propagating at the surface of the material. These surface spin waves, moreover, have the property of being preferentially localised on one of the surfaces of the material, depending upon their propagation direction.

This property has alredy been exploited in order to produce non-reciprocal junction devices, that is to say devices which permit propagation from one channel to another, in one direction only. The material is accordingly arranged in a waveguide in various ways, for example at the centre of a junction or on the waveguide walls, in order to allow propagation in only one direction and to absorb any wave tending to propagate in the reverse direction. Devices of this kind are bulky and are ill-suited to current monolithic techniques of the kind utilised in microwave microelectronic systems.

According to the invention, there is provided a multiple channel non-reciprocal junction device for microwave transmission, comprising:

a ferrimagnetic material having two substantially parallel surfaces;

means for applying a direct magnetic field;

metal layers covering parts of said surfaces in an alternate way in order that said layers are not opposite one another, each of said channels thus corresponding, at the most, to a portion of said material having two consecutive metal layers not opposite one another;

means for the emission and reception of said waves in each channel, designed for emitting and receiving spin surface waves, which are localisated, in each channel, on the part of the surface of said ferrimagnetic material which is covered with metal layers.

For a better understanding of the invention and to show how the same may be carried into effect, reference will be made to the following description and the related figures in which.

Figure 1:
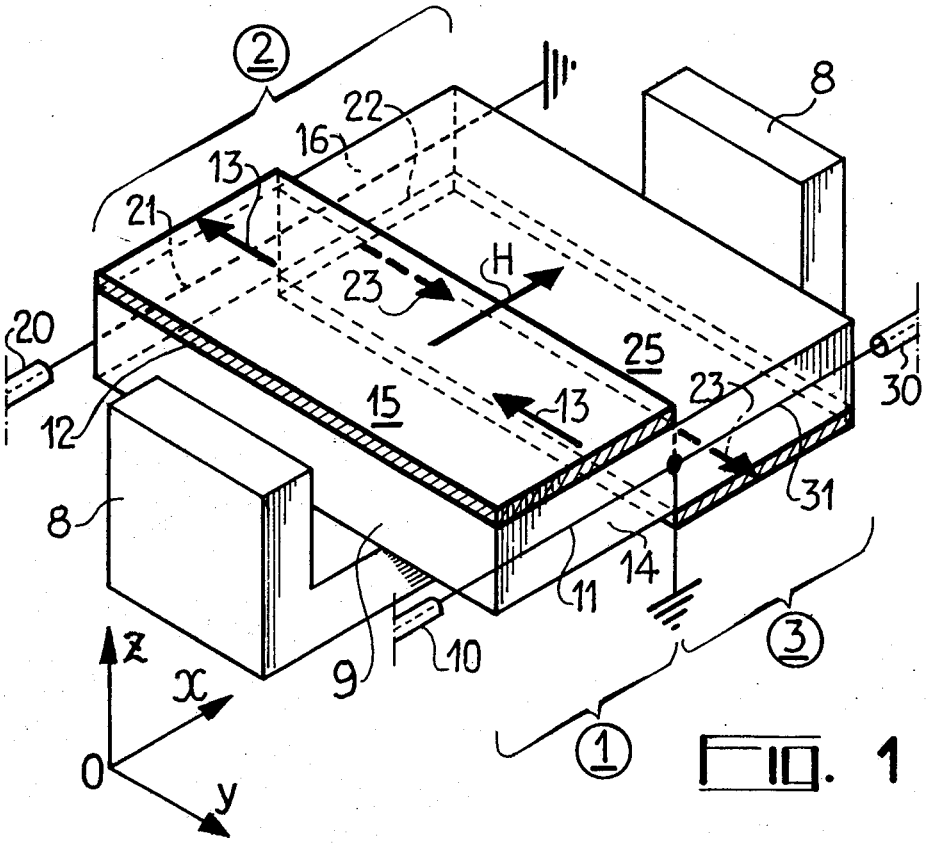
FIG. 1 illustrates a three-channel embodiment of the non-reciprocal junction in accordance with the invention.

In FIG. 1, a wafer 9 of ferrimagnetic material has been shown, constituted by either a monocrystalline or polycrystalline ferrite, subjected to a direct magnetic field H which is substantially uniform and is created, in the present example, by a permanent magnet 8, the field being directed substantially in accordance with the axis Ox of a system of rectangular co-ordinates Oxyz. The wafer 9 is partially covered on its large faces, with two metal layers, 12 and 22, arranged in such a fashion that they are not opposite one another, for example in the manner illustrated in the figure where the layer 12 covers the top left hand half of the wafer 9 and the layer 22 the bottom right hand half; the metal layers, within the thickness of the wafer, define zones 15 and 25. The device furthermore comprises microwave energy excitation devices, which in the figure take the form for example of coaxial cables 10, 20 and 30 described in more detail hereinafter.

As explained earlier on, microwave energy is capable of propagating in a ferrimagnetic material, within a certain range of frequencies, in particular in the form of so-called surface spin waves, localised preferentially at one of the two surfaces, depending upon their direction of propagation, the wave which propagates inside the material decaying in accordance with an exponential law.

However, this decay is a function of the wavelength $\lambda$ of the spin wave and, of course, of the thickness of the wafer so that it will be appreciated that it is not possible to obtain total attenuation of the wave at the other face, except in respect of very short wavelengths $\lambda$, this in view of the thickness of the wafers normally used (of the order of 1 mm). The velocity of propagation of these spin waves becomes very low as $\lambda$ reduces, so that the losses occurring during their propagation become substantial and a wafer of this kind cannot therefore be employed in practice as a non-reciprocal junction.

To overcome this drawback, recourse has been had to metallising the face at which the spin wave is preferentially localised, and this has the effect of inhibiting reverse propagation of the spin wave within the material, over a certain frequency range, as calculations and experience have shown.

In FIG. 1, the emission of the microwave to be transmitted is effected by means of a wire conductor 11 belonging to a coaxial cable 10 and earthed, said cable passing along the left hand part of one face 14, just touching this face of the wafer 9, parallel to the plane xOz. The surface spin wave created by microwave energy coming from the cable 10, this defining the channel 1, propagates substantially normally to the field H, that is to say in the direction Oy (arrow 13) and solely in the zone 15. At the other end of the wafer 9, the microwave energy is picked for example by means of a similar device: a coaxial cable 20, wire conductor 21 passing along the whole of the face 16 (parallel to the face 14), just touching this face, and earthed, this defining the channel 2. Similarly, if microwave energy coming from the channel 2 is applied to the wafer 9, the surface spin wave created there can only propagate in this direction (arrow 23) in the right hand half of the wafer, which carries the metal layer 22 (zone 25), propagation through the zone 15 being inhibited by the metal layer 12. The energy is picked off across the terminals of a wire conductor 31 one end of which is earthed and the other of which belongs to a coaxial cable 30, defining the channel 3.

Thus, a non-reciprocal three-channel junction has been created, the microwave energy coming from the channel 1 being directed exclusively to the channel 2, and that coming from the channel 2 being directed exclusively to the channel 3.

A variant embodiment (not shown) of the device described hereinbefore, consists in arranging a material which absorbs microwaves, on those faces of the wafer which are located opposite the metallised areas 12 and 22.

By way of example, the dimensions of this kind of wafer may be as follows: a thickness in the order of 1 mm, a length along the axis Oy, of around 2 to 5 mm and a length along the axis Ox of around 10 mm, the thickness of the metal layers 12 and 22, being in the order of say 10 microns.

Figure 2:
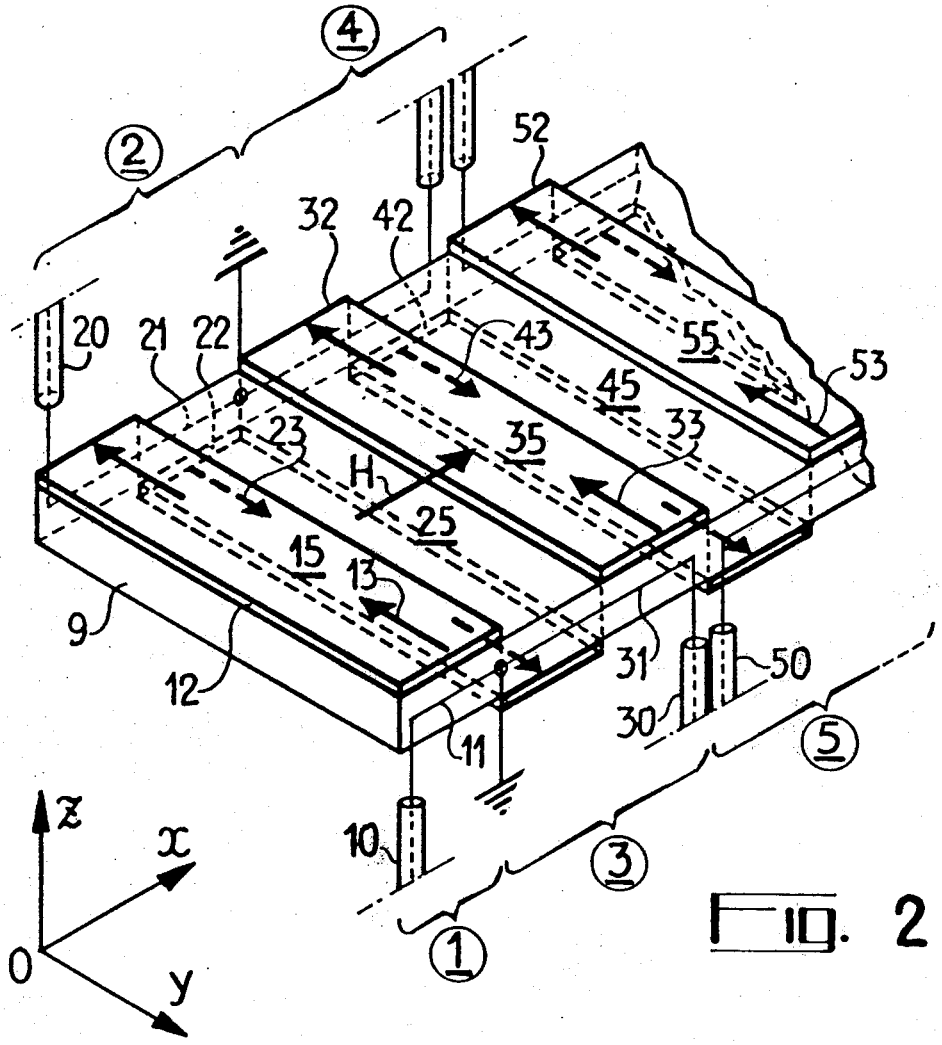
FIG. 2 is a variant embodiment, comprising *n* channels, of the junction in accordance with the invention.

FIG. 2 illustrates a variant embodiment of the device in accordance with the invention, in which the non-reciprocal junction has $n$ channels. In this figure, there can be seen the ferrimagnetic wafer 9, the channel 1 transmitting microwave energy through the zone 15 in the direction of the axis Oy (arrow 13), and the channel 2 receiving energy from channel 1 (zone 15) and transmitting microwave energy in the opposite direction (arrow 23) towards the channel 3 (zone 25). The channel 3, like the channel 2, comprises microwave energy emission and reception means (the wire 31 belonging to the coaxial cable 30) extending over two adjacent zones, 25 and 35, which can pick up the energy towards the channel 4 (zone 35 and arrow 33). Similarly, the channels 4 and 5 correspond to the zones 35–45 and 45–55, respectively, and direct the energy in a non-reciprocal way towards the following channel.

Thus, in accordance with the invention, an $n$-channel non-reciprocal junction device for the transmission of microwave energy, can be created.

Using the devices described above, it is not possible to transmit energy towards channel 1. By contrast, the device shown in FIG. 3 is a four-channel circulator, that is to say a transmission device having characteristics such that an electro-magnetic wave entering one channel, chosen as the input channel, is transmitted through only one output channel, which is adjacent the first.

Figure 3:
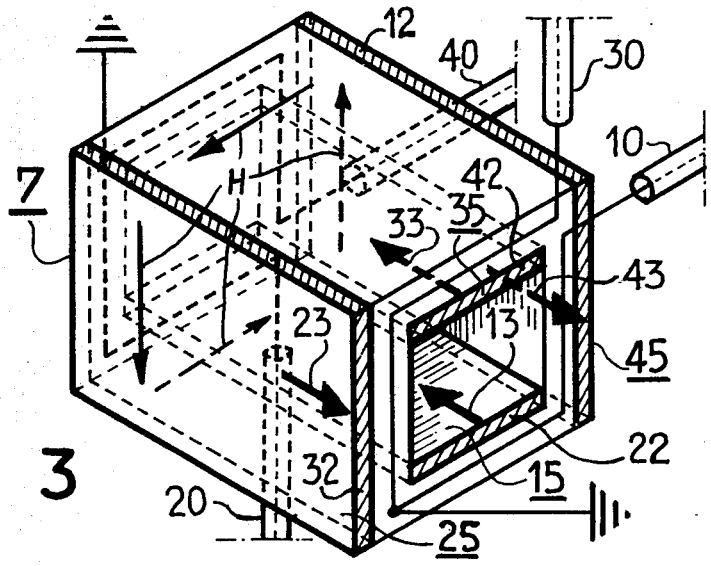
FIG. 3 illustrates a four-channel circulator in accordance with the invention.

FIG. 3 illustrates by way of example a hollow cylinder 7 with a square base, constituted by a polycrystalline ferrimagnetic material; it could of course be constituted by a cylinder with a circular base. It carries two longitudinal metal layers on each of its internal and external surfaces: the layers 22 and 42 on the internal surface and the layers 12 and 32 on the external surface, the different layers, as before, not being disposed opposite one another. Thus, four zones 15, 25, 35 and 45 are defined. The cylinder 7, as before, is subjected to the magnetic field H which is substantially normal to the direction of propagation of the spin waves in the material.

The operation of the device is similar: the energy propagates from channel 1 to channel 2 through the zone 15 (arrow 13), from channel 2 to channel 3 through the zone 25 (arrow 23), from the channel 3 to the channel 4 through the zone 35 (arrow 33) and, finally, from the channel 4 to the channel 1 through the zone 45 (arrow 43).

By way or example, a cylinder of this kind could have a diameter of the order of 5 cm.

The invention, in one of its embodiments described hereinbefore by way of non-limitative example, thus makes it possible to create small non-reciprocal junctions, operative even in the lower microwave energy range. On the other hand, junctions of this kind are particularly suitable for applications to monolithic kinds of microwave microelectronic systems.

What is claimed is:

1. A microwave multiple channel non-reciprocal junction device having first, second . . . $m^{th}$ junctions and first, second, . . . $n^{th}$ channels, $m$ and $n$, being integers greater than 1 and $n \leq m \leq n+1$, for the propagation of spin surface waves from the $p^{th}$ channel $(1 < p < n-1)$ to the $(p+1)^{th}$ channel through the $p^{th}$ junction, said junctions having linear parallel propagation axes, said junction device comprising:

a ferrimagnetic material having a substantially constant thickness, said material having major opposite faces and two end parallel lateral faces orthogonal to said major faces, said propagation axes being orthogonal to said end faces;

inductor means for applying, within said ferrimagnetic material, a DC magnetic field within said major faces, parallel to said end faces;

$m$ parallel successive metal strips alternately located on parts of said major opposite faces along a direction parallel to said propagation axes, said parallel metal strips defining in said ferrimagnetic material adjacent underlying portions, two of said underlying portions consecutive one another having their corresponding metal strips respectively located on one and the other of said major faces, one of said metal strips and the corresponding underlying portion forming one of said junctions;

electrical means for coupling said $p^{th}$ channel and said $(p+1)^{th}$ channel to said $p^{th}$ junction, located on said end faces, said electrical means being adapted for emitting and receiving said spin surface waves.

2. A device as claimed in claim 1, wherein said magnetic field is substantially uniform throughout each of said junctions, and wherein, for one of said junctions said field being along an axis Ox, O being a conventional origin, Oy being the propagation axis of the said junction and Oz being an axis normal to said major faces issued from the metal strip of said junction towards the outer of said portion of material, Ox, Oy and Oz define a direct trihedron.

3. A device as claimed in claim 1, wherein said ferrimagnetic material has the form of a wafer having main parallel faces, said major faces being said main faces of said wafer.

4. A device as claimed in claim 3, wherein said magnetic field is substantially uniform.

5. A device as claimed in claim 1, wherein, $m$ being equal to $n+1$, said ferrimagnetic material having the form of a hollow cylinder having an inner and an outer opposite faces; said metal strips being disposed alternately on said inner and outer faces of the material, said $n^{th}$ and said first channels are coupled through said $m^{th}$ junction.

6. A device as claimed in claim 5, wherein said hollow cylinder has a square outline.

* * * * *